United States Patent [19]

Chikama et al.

[11] Patent Number: 4,967,691

[45] Date of Patent: Nov. 6, 1990

[54] DEVELOPING APPARATUS FOR ELECTROPHOTOGRAPHIC APPARATUS

[75] Inventors: Atsushi Chikama, Tokyo; Toshihiro Isshiki, Matsuyama; Masahiro Kita, Tokyo, all of Japan

[73] Assignee: Asahi Kogaku Kogyo Kabushiki Kaisha, Tokyo, Japan

[21] Appl. No.: 218,865

[22] Filed: Jul. 14, 1988

[30] Foreign Application Priority Data

| | | | |
|---|---|---|---|
| Jul. 17, 1987 | [JP] | Japan | 62-178517 |
| Jul. 17, 1987 | [JP] | Japan | 62-178518 |
| Jul. 17, 1987 | [JP] | Japan | 62-109895-8 U] |
| Sep. 8, 1987 | [JP] | Japan | 62-137066[U] |

[51] Int. Cl.[5] ..... G03G 15/08

[52] U.S. Cl. ..... 118/656; 118/689; 355/245; 222/DIG. 1

[58] Field of Search ..... 118/656–658, 118/689, 691; 222/DIG. 1; 355/251, 253, 245, 246

[56] References Cited

U.S. PATENT DOCUMENTS

| | | | |
|---|---|---|---|
| 4,030,447 | 6/1977 | Takahashi et al. | 355/251 X |
| 4,147,127 | 4/1979 | Terashima | 118/658 X |
| 4,168,901 | 9/1979 | Ito et al. | 355/251 X |
| 4,285,297 | 8/1981 | Suzuki | 118/658 X |
| 4,354,763 | 10/1982 | Koiso et al. | 118/658 X |
| 4,572,631 | 2/1986 | Kondo | 118/658 X |

*Primary Examiner*—R. L. Moses

*Attorney, Agent, or Firm*—Sandler, Greenblum & Bernstein

[57] ABSTRACT

A developing apparatus is provided for use in an electrophotographic apparatus. The developing apparatus includes a developer case in which a developer having a mixture of a toner and a carrier is stored, a developing roll which is located in the developer case and which is partially exposed to the outside of the developer case adjacent to a photosensitive drum, a front stirring roll which is located below the developing roll in the developer case to make a flow of developer in the developer case and below the developing roll, a rear stirring roll which is located rearwardly of the front stirring roll in the developer case to create a flow of developer in a direction opposite to the direction of flow of the developer produced by the front stirring roll, and a guide plate located between the front and rear stirring rolls for guiding most of the developer which falls form the developing roll towards the front stirring roll.

22 Claims, 5 Drawing Sheets

DEVELOPING APPARATUS FOR ELECTROPHOTOGRAPHIC APPARATUS

BACKGROUND OF THE INVENTION

1. Field of the invention

The present invention relates to an electrophotographic apparatus, and more precisely it relates to a developing apparatus thereof.

2. Description of Related Art

In an electrophotographic apparatus, an electrostatic latent image is formed on an electrostatic photosensitive drum, such as a selenium drum which is uniformly charged, so that a toner or a color toner (including black), which is charged with electric charges having the same polarity as that of the electric charges with which the photosensitive drum is charged, is applied to the latent image to develop the toner. The developed toner is then transferred to an object, such as paper, by a transfer charging process. This kind of electrophotographic apparatus is widely used in image processing apparatus, such as a copier or a transfer type of facsimile.

There are two types of developers, one having a single component and the other having two components, i.e., a toner and a carrier which is mixed with the toner at a predetermined mixing ratio, used in the developing apparatus in of an the electrophotographic apparatus. The two-component developer has a higher resolving power than the one-component developer. When the two-component developer comes into contact with the photosensitive drum, the toner is applied to the latent image and the carrier is recovered. To achieve good development, it is necessary to bring the developer into uniform contact with the photosensitive drum in all directions of the photosensitive drum, including the axial direction thereof. Also, the toner must be uniformly mixed with the carrier. It should be remembered that the toner is consumed but the carrier is not. Accordingly, it is necessary to detect the consumption of the toner in order to supplementarily feed toner in accordance with the results of such detection, to thereby maintain the mixing ratio of the toner and the carrier within a predetermined range.

To this end, it is known to provide in a developing unit a stirrer (agitator) for stirring the toner, a supplemental feeder for supplementarily feeding the toner, and/or a toner sensor for detecting the consumption of the toner. However, the conventional developing units are complex in construction and expensive with respect to their manufacturing cost.

SUMMARY OF THE INVENTION

The primary object of the present invention is to provide a simple and inexpensive developing apparatus which has a high developing efficiency.

Another object of the present invention is to provide an elecrophotographic apparatus which can effectively stir the toner and the carrier, precisely detect the amount of the toner in the developer, and quickly supplementarily feed toner in response to the consumption of the toner, so that developer including well mixed toner and carrier can always be fed to a developing roll, and the mixing ratio of the toner and the carrier can always be kept within a predetermined narrow allowable range.

To achieve the object of the invention, according to one aspect of the present invention, there is provided a developing apparatus, essentially comprising a developer case in which a developer having a mixture of a toner and a carrier is stored, a developing roll which is partially located outside the developer case, close to a photosensitive medium, and which has a rotatable sleeve to which the developer can be applied at the outer periphery of the sleeve, a front stirring roll which is located below the developing roll to create a flow of developer in the developer case and below the developing roll, a rear stirring roll which is located rearwardly of the front stirring roll to create a flow of developer in a direction opposite to the direction of flow of the developer produced by the front stirring roll, and a guide plate, located between the front and rear stirring rolls, mainly for guiding the developer which falls from the developing roll toward the front stirring roll.

According to another aspect of the invention, front and rear connecting passages are provided at the front and rear axial ends of the front and rear stirring rolls to establish a flow, i.e., fluidic connection for the developer, between the front stirring roll and the rear stirring roll. One of the front and rear connecting passages forms a first passage in which the developer flows from the front stirring roll toward the rear stirring roll, and the other connecting passage forms a second passage in which the developer flows from the rear stirring roll towards the front stirring roll. Preferably, the second passage has a larger cross sectional area than does the first passage. The flow rate of the developer produced by the front stirring roll is higher than or equal to that of the developer produced by the rear stirring roll, so that a sufficient amount of developer can be uniformly and more stably fed to the photosensitive medium along the whole length thereof by the developing roll.

According to still another aspect of the invention, a toner hopper is provided above the rear stirring roll to supplementarily feed toner into the developer case. The toner hopper is provided, on its bottom, with a feeding opening which is normally closed by a rotatable dosing shaft which is provided, along its periphery, with a partial dosing recess. The dosing shaft is rotatably supported in the feeding opening. The dosing shaft is connected to an actuator or a drive for rotating the same, so that when the dosing shaft is rotated to establish a connection between the toner hopper and the developer case, the toner in the toner hopper can be fed into the developer case.

Preferably, the dosing recess of the dosing shaft can be provided with a projecting tongue secured thereto which is made of an elastic film. The projecting tongue projects outwardly from the dosing recess, so that when the dosing shaft rotates, the projecting end of the projecting tongue comes into engagement with and disengagement from the feeding opening to ensure that the toner in the dosing recess can be fed or discharged into the developer case during every single turn of the dosing shaft.

A stirring shaft which is provided, on its shaft portion, with a stirring blade, can be rotatably supported in the toner hopper. The dosing shaft and the stirring shaft can be driven in response to the detection signal of the toner sensor, which detects the amount of the toner and accordingly the consumption of the toner to supplementarily feed the toner, to thereby maintain the mixing ratio of the toner and the carrier at a predetermined value which is preferably constant.

The developing roll and the front stirring roll can be extended to project from one end of the photosensitive medium (when viewed in the side elevational view), so that the toner sensor can be oppositely disposed with respect to the projecting end of the developing roll to more accurately effect measurement of the amount of the toner.

BRIEF DESCRIPTION OF DRAWINGS

The invention will be hereinafter described below in detail with reference to the accompanying drawings, in which like reference numerals are used to describe similar parts throughout the several views, and wherein.

DETAILED DESCRIPTION OF THE INVENTION

Figure 6:
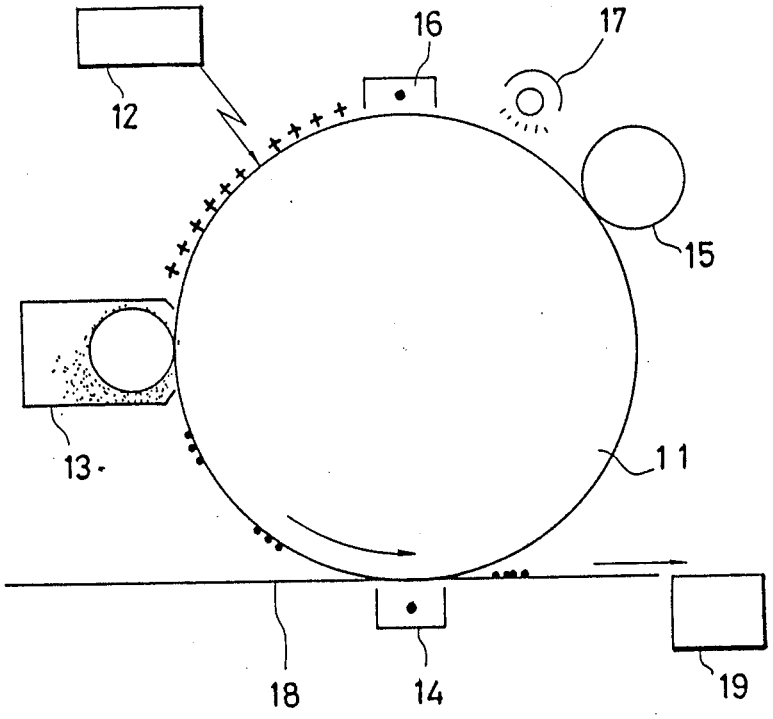
Fig. 6 PRIOR ART

First, with reference to FIG. 6 which schematically shows the principles of electrophotography, a photosensitive medium 11 which is, for example, in the form of a selenium photosensitive drum in the illustrated embodiment rotates in the direction (i.e., the counterclockwise direction in FIG. 6) shown by the arrow. The photosensitive drum 11 is surrounded by an electrostatic latent image forming unit 12, a developing unit 13, a transferring charger (corona discharger) 14, a cleaning brush 15, and a photosensitive drum charger 16, arranged in this order as viewed in the direction of rotation of the photosensitive drum 11. Between the cleaning brush 15 and the charger 16 a charge eraser 17 is provided which provides a uniform surface voltage of the photosensitive drum 11.

For instance, in the case of reverse development, the photosensitive drum 11 is uniformly charged with positive or negative electric charges by the photosensitive drum charger 16. When the photosensitive drum 11 is illuminated with light having image data by the electrostatic latent image forming unit 12, electric charges are produced on the illuminated portion of the photosensitive drum 11 to reduce the surface voltage of the photosensitive drum 11. Namely, a voltage difference is created between the illuminated portion and the non-illuminated portion of the photosensitive drum 11, so that an electrostatic latent image is formed. After that, the toner or the color toner, which has either positive or negative electric charges, the polarity of which is same as that of the photosensitive drum 11, is fed, together with the carrier, onto the photosensitive drum 11 by the developing unit 13, so that the color toner is applied onto the latent image to develop the same.

The transferring charger 14 charges a PPC paper 18 (object) on which the image is to be transferred with electric charges of the opposite polarity to the polarity of the toner to transfer the color toner applied to the photosensitive drum 11 onto the PPC paper 18. Namely, the toner which has been applied to the latent image of the photosensitive drum 11 is transferred onto the PPC paper 18 as a result of the charging of the PPC paper 18 with the opposite electric charges to the charges of the toner. The transferred toner is then fixed by a fixing unit 19.

The residual toner on the photosensitive drum 11 is removed by the cleaning brush 15. The photosensitive drum charger 16 is adapted to return the polarity of the surface voltage of the photosensitive drum 11 to an initial positive or negative polarity.

The improvement of the present invention is mainly addressed to the developing unit 13 in the electrophotographic apparatus, as mentioned above.

FIGS. 1 to 5 illustrate embodiments of a developing apparatus of the present invention.

The developing apparatus 20 has a developer case 21 in which a developing roll 22, a front stirring roll 23, and a rear stirring roll 24 are supported so as to rotate about their rotating axes parallel to each other. A cylindrical toner hopper 25 is secured to the developer case 21. The longitudinal axis of the cylindrical toner hopper 25 extends parallel to the axes of the rolls 22, 23 and 24. The front stirring roll is located below the developing roll 22, and the rear stirring roll 24 is located below the toner hopper 25. The front and rear stirring rolls are located at the same level of height. A part of the developing roll 22 projects outwardly from the developer case 21 towards the photosensitive drum 11. The above-mentioned elements arranged in the developer case 21 are sealed in the developer case except for the partial projecting portion of the developing roll 22.

The front and rear stirring rolls 23 and 24 can be embodied by screw shafts having spiral fins **23*b* and 24*b* which are provided, on their ends projecting from the developer case 21, with gears 23*a* and 24*a* (FIG. 2) which are in mesh with each other, respectively, so that the front and rear stirring rolls 23 and 24** can rotate at the same rotational speed and in opposite directions.

The developing roll 22 has a rotatable cylindrical metal sleeve **22*a* having predetermined thickness and a stationary magnetic shaft 22*b* which is secured in the rotatable sleeve 22*a* so as not to rotate. The rotatable sleeve 22*a* rotates synchronously with the front and rear stirring rolls 23 and 24. The directions of rotation of those rolls are shown by the respective arrow in FIG. 1. The rotation of the front and rear stirring rolls 23 and 24 produces flows of developer in opposite directions below the developing roll 22 and below the toner hopper 25. Namely, the developer flows (moves) in one direction below the developing roll 22 and in the opposite direction below the toner hopper 25**.

Figure 1:
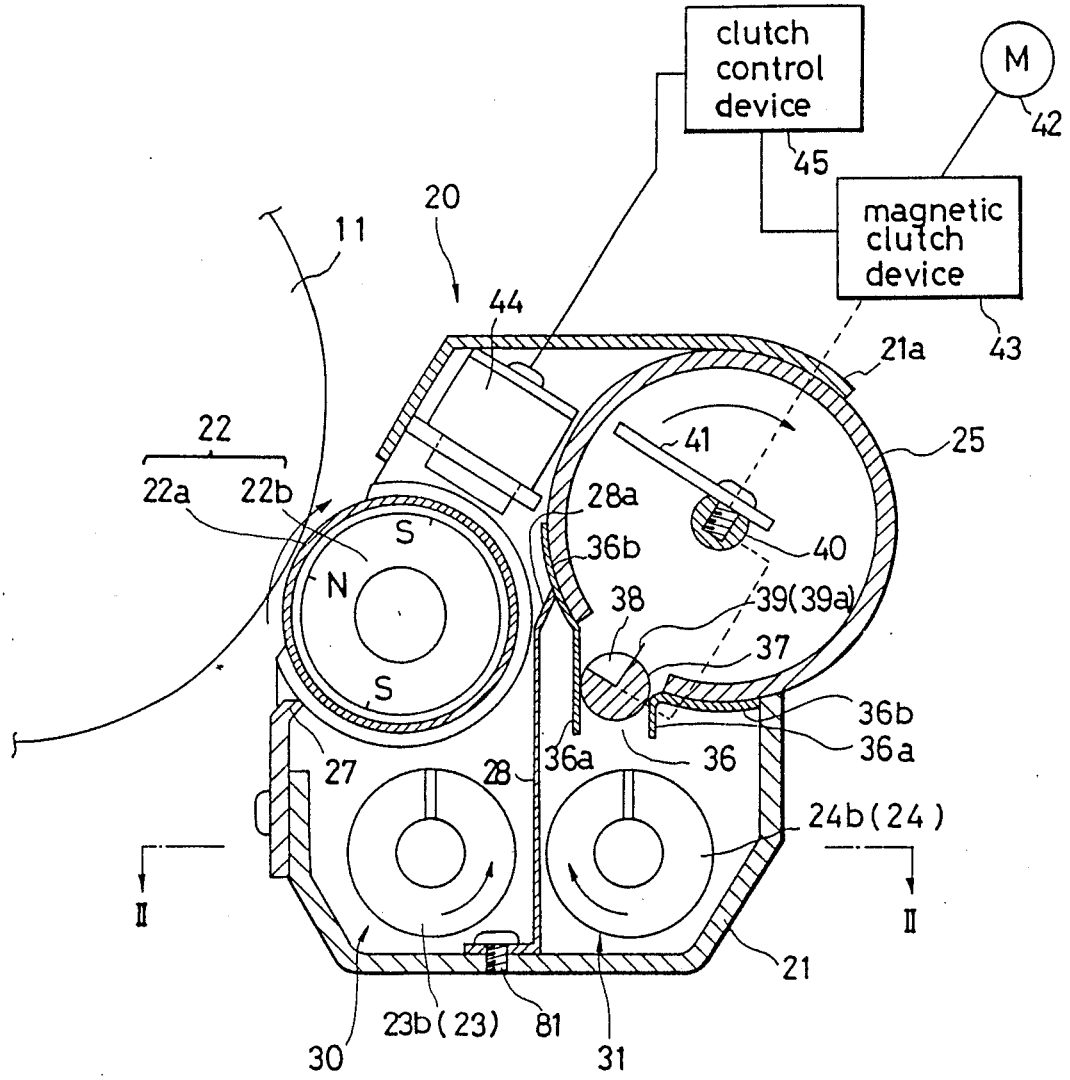
FIG. 1 is a longitudinal sectional view of a developing apparatus in forming part of an electrophotographic apparatus, according to one aspect of the present invention.

The magnetic shaft **22*b* has polarities (N and S) as shown in FIG. 1, so that the developer, which is a mixture of a toner and a carrier made of magnetic powder, is magnetically attracted by the magnetic shaft 22*b* onto the outer periphery of the rotatable sleeve 22*b*. The thickness of the developer applied on the rotatable sleeve 22*b* is restricted by a doctor plate 27, so that the leading end of the developer comes into contact with the photosensitive drum 11**.

Figure 5:
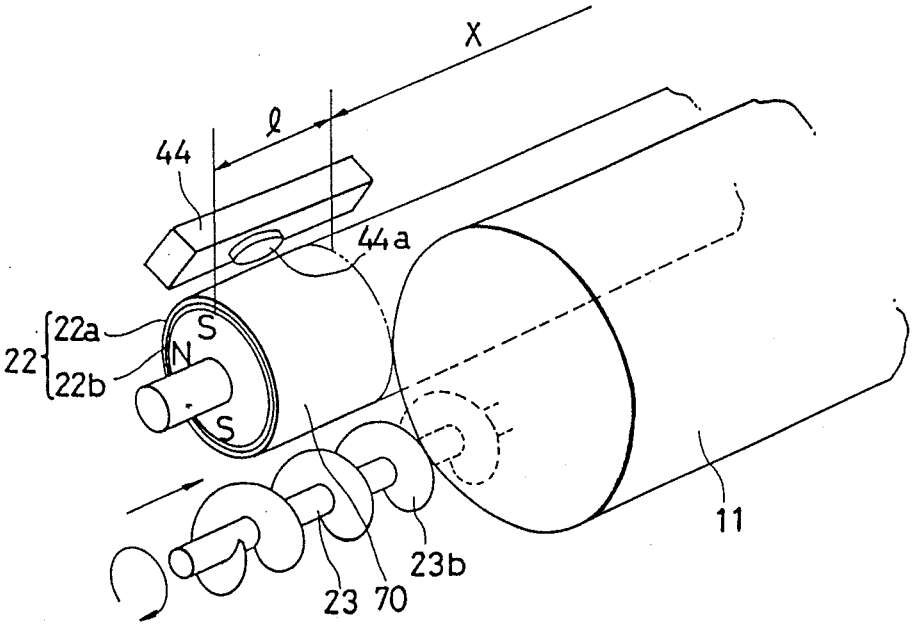
FIG. 5 is a perspective view showing an arrangement of a photosensitive drum, a developing roll, and a toner sensor, in a developing apparatus according to the present invention, by way of an example; and, FIG. 6 is a schematic view of a known electrophotographic apparatus to which the present invention can be applied.

The developer roll 22 has a projecting end (axial extension) 70 which has a length 1 projecting (when viewed in the side elevational view) from the terminal end of the photosensitive drum 11 on the upstream side of the flow of the developer caused by the front stirring roll 23, as shown in FIG. 5.

Between the front and rear stirring rolls 23 and 24 is provided a guide plate 28 which guides the developer falling from the developing roll 22 into the developer case 21. The guide plate 28 is secured at its lower end to the bottom of the developer case 21 by means of a set screw 81. The upper portion of the guide plate 28 is located close to the side of the developing roll 22 and has an inclined upper end 28*a* which is bent towards the toner hopper 25. The inclined upper end 28*a* brings almost all of the falling developer past the top of the developing roll 22 into the portion of the developer case 21 located close to the front stirring roll 23.

The guide plate 28 defines a front passage or compartment 30 having therein the front stirring roll 23 and a rear passage or compartment 31 having therein the rear stirring roll 24. The guide plate 28 also forms a first connecting passage 32 which connects the upstream end of the front passage 30 and the downstream end of the rear passage 31, and a second connecting passage 33 which connects the downstream end of the front passage 30 and the upstream end of the rear passage 31. The cross sectional area of the first connecting passage 32 is larger than that of the second connecting passage 33.

The feed speed of the developer fed by the front stirring roll 23 and the rear stirring roll 24 is such that the speed of the developer moved by the front stirring roll 23 (in the front passage 30) is equal to or larger than the speed of the developer moved by the rear stirring roll 24 (in the rear passage 31). In the illustrated embodiment, the speed of the developer can be determined by the pitches p and p' (FIG. 2) of the spiral fins 23*b* and 24*b* of the front and rear stirring rolls 23 and 24. In other words, the pitches p and p' of the spiral fins 23*b* and 24*b* are determined taking the above-mentioned speeds of the developer into consideration.

The toner hopper 25 has at its lower end a feeding opening 36 which opens into the developer case 21. The opening 36 is defined by a pair of guide walls (plates) 36*a* which are secured to the toner hopper 25 and hang therefrom. Between the guide plates 36*a* is provided a dosing shaft (dosing means) 37 which comes into contact with the guide plates 36*a* at the peripheral surface of the dosing shaft 37 and which is rotatably supported by the developer case 21 or the toner hopper 25. The guide plates 36*a* are preferably made of an elastically deformable material, such as a leaf spring, so that they are continuously and elastically biased toward the dosing shaft 37 to bring the guide plates 36*a* into elastic contact with the dosing shaft 37. Note that proper seal members (not shown) are provided between the longitudinal opposite ends of the dosing shaft 37 and the corresponding opposite ends of the guide plates 36*a* to seal the toner hopper 25.

The dosing shaft 37 is provided, on its outer periphery, with a dosing recess 38 which is in the form of a generally V-shaped groove in the illustrated embodiment. In the dosing recess 38 is provided an elastic film 39 applied thereto and extending therealong. Preferably, the elastic film 39 is made of an insulated restorable material, such as polyimide film or the like. The elastic film 39 is secured at one end to one end of the dosing recess 38 (i.e., it is secured to the dosing shaft 37) and extends from the dosing shaft 37 at the opposite end of the elastic film 39 to form a projecting tongue 39*a*. The projecting tongue 39*a* projects outwardly from the dosing shaft 37 at one side (i.e., at an inclined side face) of the V-shaped dosing recess 38 that is located rearwardly, as viewed in the direction of rotation of the dosing shaft 37. The elastic film 39, including the projecting tongue 39*a* extends to cover the entire surface of the inclined side faces of the dosing recess 38 along the axial direction of the dosing shaft 37. Alternatively, it is also possible to provide a plurality of discontinuous tongues 39*a* at a predetermined distance along the axial direction of the dosing shaft 37.

Figure 4A:
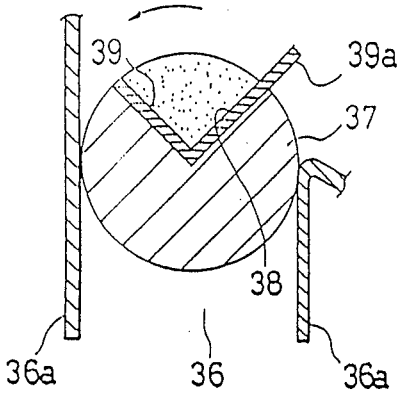
FIGS. 4A and 4B are enlarged views of a dosing shaft with a dosing recess and an elastic film, shown in different operational positions, according to an embodiment of the present invention.
Figure 4B:
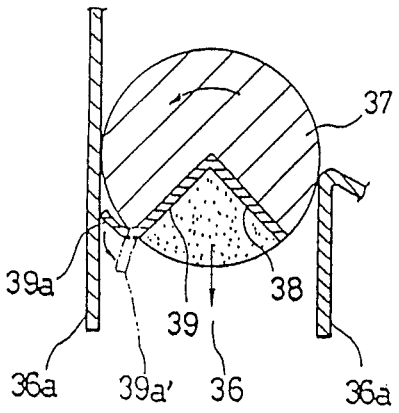

The dosing recess 38 receives the toner which falls from the toner hopper 25 when the dosing recess 38 faces upwardly, i.e., when it faces the toner hopper 25. The toner received in the dosing recess 38 falls into the developer case 21 when the dosing recess 38 faces downwarly. The dosing shaft 37 normally occupies an angular position (i.e., a stop position) in which the dosing recess 38 faces upwardly towards the toner hopper 25. The dosing shaft 37 can rotate while contacting the guide plates 36*a* at the outer periphery of the dosing shaft. When the dosing shaft 37 rotates in the counterclockwise direction, the projecting tongue 39*a* is bent rearwardly in the direction of the rotation by the left guide wall 36*a*, as shown in FIGS. 1, 4A and 4B. When the dosing shaft 37 move past a downwardly facing position in which the dosing recess 38 faces vertically downwardly, i.e., by continuing to rotate, the projecting tongue 39*a* is separated from the associated left guide wall 36*a*. As soon as the projecting tongue 39*a* is disengaged from the left guide wall 36*a*, the projecting tongue 39*a* is automatically returned to its initial free state due to the elastic restoration thereof, as shown by an imaginary line 39*a*' in FIG. 4B. At the restoration of the projecting tongue 39*a*, the tongue is subjected to a slight shock or slight vibration, so that the toner which tends to remain on the elastic film 39, if any, falls into the developer case 21. As a result, a predetermined amount of toner which is received in the dosing recess 38 is fed into the developer case 21 during every one turn of the dosing shaft 37.

A stirring shaft 40 is rotatably supported in the toner hopper 25 at the center of the latter. The stirring shaft 40 has a stirring blade 41 secured thereto, so that when the stirring shaft 40 rotates, the stirring blade 41 stirs the toner in the toner hopper 25 to effectively feed the toner into the dosing recess 38. The stirring shaft 40 is rotated by a drive motor 42 through a magnetic clutch device 43. The dosing shaft 37 is kinematically connected to the stirring shaft 40, so that the dosing shaft 37 can be rotated in association with the stirring shaft 40 at a predetermined ratio of number of revolutions.

A toner sensor 44 is provided above and is opposed to the developing roll 22. The toner sensor 44, which is known per se, has, for example, a magnet sensing coil, a transmitter and a wave detector of detected signals (all not shown). The toner sensor 44 detects variations of the apparent magnetic permeability, depending on variations of the density of the toner in the developer located close to the surface of the sensing coil, and outputs the corresponding direct current voltage. Namely, the toner density in a developer can be detected by the value of the output voltage of the toner sensor 44.

The toner sensor 44 has a sensing element 44*a* which is disposed oppositely from the projecting end (axial extension) 70 (1 in FIG. 5) of the developing roll 22 at a predetermined distance. Namely, as mentioned before, the developing roll 22 and the front stirring roll 23 project (when viewed in the side elevational view) from the upstream end of the photosensitive drum 11, by the length 1 in the upstream direction of the movement of the developer past the front stirring roll 23. "X" in FIG. 5 designates the developing area in the axial direction of the photosensitive drum 11.

The toner sensor 44 is electrically connected to a clutch control device 45 which controls the magnetic clutch device 43, so that when the consumption of the toner is detected by the toner sensor 44, the stirring shaft 40 and the dosing shaft 37 rotate by a predetermined number of turns. The developing roll 22, the front stirring roll 23, and the rear stirring roll 24 are driven by the motor 42 through respective transmission mechanisms (not shown).

Figure 2:
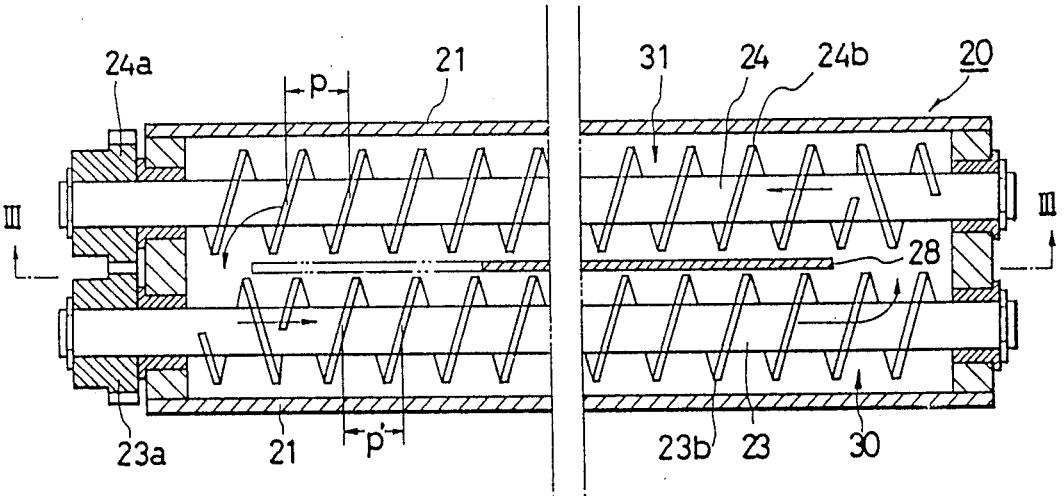
FIG. 2 is a longitudinal section view taken along line II—II of FIG. 1.
Figure 3:
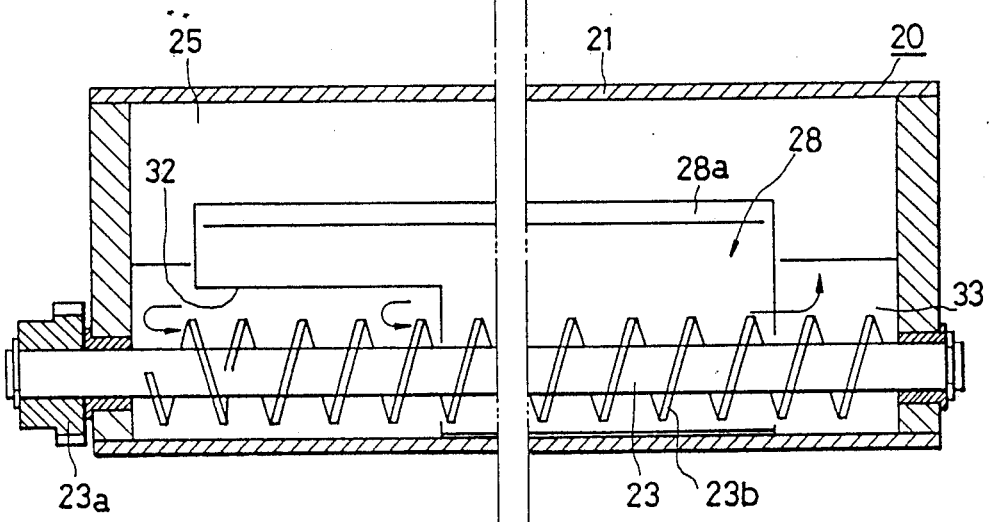
FIG. 3 is a longitudinal sectional view taken along line III—III in FIG. 2.

In the developing apparatus mentioned above, when the developing roll 22, the front stirring roll 23, and the rear stirring roll 24 are driven, the flow of developer which recirculates between the front passage 30 and the rear passage 31 are formed by the front and rear stirring rolls 23 and 24, as shown by arrows in FIGS. 2 and 3, respectively. In the front passage 30, the developer is partly applied to the periphery of the developing roll 22. The thickness (height) of the developer on the developing roll 22 is restricted by the doctor plate 27, as mentioned before. The developer applied to the developing roll 22 comes into contact with the surface of the photosensitive drum 11, so that only the toner is applied to the latent image formed on the photosensitive drum 11. The carrier and the residual toner which are not applied to the photosensitive drum 11 fall into the front passage 30 (onto the front stirring roll 23) with the help of the guide plate 28 due to the disappearance of the magnetic attraction by the magnetic shaft **22*b*, so that the amount of developer which is necessary can be maintained in the front passage 30**.

Since the second connecting passage 33 is narrower than the first connecting passage 32, as mentioned before, the amount of developer which flows from the front passage 30 into the rear passage 31 is less than the amount of developer which flows from the rear passage 31 into the front passage 30. Namely, a part of the developer tends to remain in the front passage 30. This ensures that the developer can be supplementarily fed onto the developing roll 22.

Since the feed speed of the developer by the front stirring roll 23 is equal to or smaller than that of the developer by the rear stirring roll 24, as mentioned above, the necessary amount of developer can be maintained in the front passage 30, and high stirring efficiency can be ensured.

The amount of toner contained in the developer is detected by the toner sensor 44. The detection can be effected outside the developing area X of the photosensitive drum 11, as mentioned before. Namely, the toner sensor 44 detects the amount of toner contained in the developer which is not directly consumed to develop the latent image, resulting in more accurate detection of the toner density.

The detection signal of toner sensor 44 is input to the clutch control device 45, in which the detection signal is compared with a reference value. If the toner density is below the reference value, the stirring shaft 40 and the dosing shaft 37 are rotated by a predetermined number of turns by the drive motor 42, through the clutch control device 45 and the magnetic clutch device 43. As a result, the amount of toner held in the dosing recess 38, corresponding to the number of turns of the dosing shaft 37, falls into the developer case 21 to supplementarily feed toner.

Namely, when the dosing recess 38 of the dosing shaft 37 which rotates begins facing the developer case 21, the projecting tongue **39*a* of the elastic film 39 is bent rearwardly in the direction of rotation of the dosing shaft 37 by the guide wall 36*a* of the opening 36. By a further rotation of the dosing shaft 37, past the vertically downwardly facing position in which the dosing recess 38 faces vertically downwardly, the projecting tongue 39*a* is disengaged from the associated guide wall 36*a*, so that the projecting tongue 39*a* is elastically returned to its initial free state in a snap-like fashion. Due to the return of the projecting tongue 39*a*, the entire elastic film 39 receives a slight shock or vibration, so that the toner which would be otherwise retained on the elastic film 39 can fall into the developer case 21. The toner which falls in the developer case 21 is stirred, at least in rear passage 31, and is then brought into the front passage 30. This ensures that the developer which is to be attracted by and applied to the developing roll 22** can be fully stirred.

It takes a certain period of time before the toner which is supplementarily fed reaches the portion of the developing roll 22 that is oppositely disposed with respect to the toner sensor 44. Accordingly, it is preferable to provide means for invalidating the detection signal of the toner sensor 44 for a certain period of time after the magnetic clutch device 43 is made ON by the clutch control device 45.

Furthermore, although the subject of the present invention is not directed to how the toner can be supplementarily fed into the toner hopper 25, it is possible to provide an exchangeable toner hopper 25 which is detachably inserted into the developer case 21, in the axial direction between holding member **36*b* which is integral with the guide walls 36*a*, and an upper arcuate ledge 21*a*, which is an integral part of the developer case 21. The toner can be supplementarily fed, e.g., by exchanging the toner hopper 25** for a new toner hopper which contains a sufficient amount of toner.

The above discussion has been mainly directed to a single-color electrophotographic apparatus. However, the present invention can be similarly applied to a multicolor electrophotographic apparatus having a plurality of developing apparatuses for different colors. In this case, each of the developing apparatuses can be realized by the concept of the present invention.

We claim:

1. A developing apparatus adapted for use in an electrophotographic apparatus in which an electrostatic latent image is formed on a charged electrostatic photosensitive drum and is developed by a toner, said developing apparatus comprising a developing roll for feeding a developer containing toner to the photosensitive drum, means located below the developing roll for stirring and moving developer in a direction substantially parallel to the axis of the developing roll, said developing roll having an axial extension located exteriorly of an upstream distal end of the photosensitive drum, along the direction of the movement of the developer by said stirring and moving means, and a toner sensor which is disposed oppositely with respect to the axial extension of the developing roll in order to detect the amount of the toner.

2. A developing apparatus which is adapted to be used with an electrophotographic apparatus in which an electrostatic latent image is formed on a charged electrostatic photosensitive medium and is developed by a toner, said developing apparatus comprising a developer case in which a developer is adapted to be stored, a developing roll exposed to the exterior of the developer case in a position which is adjacent the photosensitive medium, said developing roll having an outer periphery to which the developer can be applied, a front stirring roll which is located below the developing roll in the developer case, said front stirring roll being adapted to form a flow of developer in the developer case and below the developing roll, a rear stirring roll which is located rearwardly of the front stirring roll in the developer case, said rear stirring roll being adapted to form a flow of developer in a direction which is opposite to the direction of the flow of the developer produced by the front stirring roll, and a guide plate positioned between the front and rear stirring rolls, said guide plate being adapted to guide developer which falls from the developing rolls towards the front stirring roll, connecting passages being provided at respective front and rear axial ends of the front and rear stirring rolls to establish a fluidic connection for the developer between the front stirring roll and the rear stirring roll, one of said connecting passages forming a first passage in which developer is adapted to flow from the front stirring roll towards the rear stirring roll, and the other connecting passage forming a second passage in which developer is adapted to flow from the rear stirring roll towards the front stirring roll, a toner hopper positioned above the rear stirring roll for supplementarily feeding the toner into the developer case, said toner hopper having a feeding opening which opens into the developer case, guiding means for defining the feeding opening of the toner hopper, said guiding means comprising elastically deformable guide plates.

3. A developing apparatus according to claim 2, wherein said second passage has a larger cross sectional area than the first passage.

4. A developing apparatus according to claim 2, wherein the flow rate of developer created by the front stirring roll is higher than the flow of the developer produced by the rear stirring roll.

5. A developing apparatus according to claim 2, wherein the flow rate of developer produced by the front stirring roll is equal to to the flow rate of developer produced by the rear stirring roll.

6. A developing apparatus according to claim 2, further comprising guiding means for defining the feeding opening of the toner hopper.

7. A developing apparatus according to claim 6, wherein said guiding means comprises elastically deformable guide plates.

8. A developing apparatus which is adapted to be used with an electrophotographic apparatus in which an electrostatic latent image is formed on a charged electrostatic photosensitive medium and is developed by a toner, said developing apparatus comprising a developer case in which a developer is adapted to be stored, a developing roll exposed to the exterior of the developer case in a position which is adjacent the photosensitive medium, said developing roll having an outer periphery to which the developer can be applied, a front stirring roll which is located below the developing roll in the developer case, said front stirring roll being adapted to form a flow of developer in the developer case and below the developing roll, a rear stirring roll which is located rearwardly of the front stirring roll in the developer case, said rear stirring roll being adapted to form a flow of developer in a direction which is opposite to the direction of the flow of the developer produced by the front stirring roll, and a guide plate positioned between the front and rear stirring rolls, said guide plate being adapted to guide developer which falls from the developing rolls towards the front stirring roll, connecting passages being proveded at respective front and rear axial ends of the front and rear stirring rolls to establish a fluidic connection for the developer between the front stirring roll and the rear stirring roll, one of said connecting passages forming a first passage in which developer is adapted to flow from the front stirring roll towards the rear stirring roll, and the other connecting passage forming a second passage in which developer is adapted to flow from the rear stirring roll towards the front stirring roll, a toner hopper positioned above the rear stirring roll for supplementarily feeding the toner into the developer case, said toner hopper having a feeding opening which opens into the developer case, dosing means in the feeding opening for feeding a predetermined amount of toner from the toner hopper into the developer case, said dosing means comprising a dosing shaft which is provided along its periphery, with a dosing recess for receiving toner in the toner hopper, said dosing shaft being rotatably supported in the feeding opening to normally close the feeding opening, guiding means defining said feeding opening, said dosing shaft being provided with an elastic film along the dosing recess, said elastic film including a projecting tongue projecting outwardly from the dosing recess, wherein when the dosing shaft rotates, the projecting tongue is adapted to engage and disengage the guiding means of the feeding opening.

9. A developing apparatus according to claim 8, wherein said dosing shaft is adapted to be rotated to occupy a position in which the dosing recess opens into the developer case so that the toner in the toner hopper is adapted to be fed into the developer case.

10. A developing apparatus according to claim 9, further comprising a rotatable stirring shaft in the toner hopper for stirring toner in said toner hopper.

11. A developing apparatus according to claim 10, wherein said rotatable stirring shaft includes a stirring blade integral therewith.

12. A developing apparatus according to claim 10, wherein said rotatable stirring shaft and said dosing shaft are adapted to rotate in synchronization with each other.

13. A developing apparatus according to claim 8, wherein said dosing shaft is provided with an elastic film along the dosing recess, said elastic film including a projecting tongue projection outwardly from the dosing recess, wherein when the dosing shaft rotates, the projecting tongue is adapted to engage and disengage the guiding means of the feeding opening.

14. A developing apparatus according to claim 9, wherein said developing roll and the front stirring roll have axial extensions projecting from ends of the photosensitive medium, wherein the apparatus further comprises a toner sensor opposed to the axial extensions for detecting the amount of toner.

15. A developing apparatus which is adapted to be used with an electrophotographic apparatus in which an electrostatic latent image is formed on a charged electrostatic photosensitive medium and is developed by a toner, said developing apparatus comprising a developer case in which a developer is adapted to be stored, a developing roll exposed to the exterior of the developer case in a position which is adjacent the photosensitive medium, said developing roll having an outer periphery to which the developer can be applied, a front stirring roll which is located below the developing roll in the developer case, said front stirring roll being adapted to form a flow of developer in the developer case and below the developing roll, a rear stirring roll which is located rearwardly of the front stirring roll in the developer case, said rear stirring roll being adapted to form a flow of developer in a direction which is opposite to the direction of the flow of the developer produced by the front stirring roll, and a guide plate positioned between the front and rear stirring rolls, said guide plate being adapted to guide developer which falls from the developing rolls towards the front stirring roll, connecting passages being provided at respective front and rear axial ends of the front and rear stirring rolls to establish a fluidic connection for the developer between the front stirring roll and the rear stirring roll, one of said connecting passages forming a first passage in which developer is adapted to flow from the front stirring roll towards the rear stirring roll, and the other connecting passage forming a second passage in which developer is adapted to flow from the rear stirring roll towards the front stirring roll, a toner hopper positioned above the rear stirring roll for supplementarily feeding the toner into the developer case, said toner hopper having a feeding opening which opens into the developer case, dosing means in the feeding opening for feeding a predetermined amount of toner from the toner hopper into the developer case, said dosing means comprising a dosing shaft which is provided along its periphery, with a dosing recess for receiving toner in the toner hopper, said dosing shaft being rotatably supported in the feeding opening to normally close the feeding opening, said dosing shaft being adapted to be rotated to occupy a position in which the dosing recess opens into the developer case so that the toner in the toner hopper is adapted to be fed into the developer case, and said developing roll and the front stirring roll having axial extensions projecting from ends of the photosensitive medium, wherein the apparatus further comprises a toner sensor opposed to the axial extensions for detecting the amount of toner.

16. A developing apparatus according to claim 15, further comprising means for rotating the dosing shaft and the stirring shaft by a predetermined number of turns in accordance with an amount of toner detected by said toner sensor.

17. A developing apparatus which is adapted to be used with an electrophotographic apparatus in which an electrostatic latent image is formed on a charged electrostatic photosensitive medium and is developed by a toner, said developing apparatus comprising a case, a toner hopper for feeding toner into said case, said toner hopper having a feeding opening which opens into said case, dosing means for feeding a predetermined amount of toner from said toner hopper into said case, said dosing means comprising a dosing shaft which is provided with means for receiving toner in said toner hopper, said dosing shaft being rotatably supported in said feeding opening to normally close said feeding opening, said dosing shaft being adapted to be rotated to feed toner into said case, and a rotatable stirring shaft in said toner hopper for stirring toner in said toner hopper, wherein said rotatable stirring shaft and said dosing shaft are adapted to rotate in synchronization with each other.

18. A developing apparatus which is adapted to be used with an electrophotographic apparatus in which an electrostatic latent image is formed on a charged electrostatic photosensitive medium and is developed by a toner, said developing apparatus comprising a developer case in which a developer is adapted to be stored, a developing roll exposed to the exterior of the developer case in a position which is adjacent the photosensitive medium, said developing roll having an outer periphery to which the developer can be applied, a front stirring roll which is located below the developing roll in the developer case, said front stirring roll being adapted to form a flow of developer in the developer case and below the developing roll, a rear stirring roll which is located rearwardly of the front stirring roll in the developer case, said rear stirring roll being adapted to form a flow of developer in a direction which is opposite to the direction of the flow of the developer produced by the front stirring roll, and a guide plate positioned between the front and rear stirring rolls, said guide plate being adapted to guide developer which falls from the developing rolls towards the front stirring roll, connecting passages being provided at respective front and rear axial ends of the front and rear stirring rolls to establish a fluidic connection for the developer between the front stirring roll and the rear stirring roll, one of said connecting passages forming a first passage in which developer is adapted to flow from the front stirring roll towards the rear stirring roll, and the other connecting passage forming a second passage in which developer is adapted to flow from the rear stirring roll towards the front stirring roll, wherein said second passage has a larger cross section than said first passage so that developer tends to be maintained at said front stirring roll.

19. A developing apparatus according to claim 18, further comprising means for restricting thickness of developer which is applied to the developing roll.

20. A developing apparatus which is adapted to be used with an electrophotographic apparatus in which an electrostatic latent image is formed on a charged electrostatic photosensitive medium and is developed by a toner, said developing apparatus comprising a case, a toner hopper for feeding toner into said case, said toner hopper having a feeding opening which opens into said case, a dosing shaft having an outer periphery being located in said feeding opening, guiding means for defining said feeding opening, wherein said guiding means comprises elastically deformable guide plates, said guide plates tangentially contacting the outer periphery of said dosing shaft.

21. A developing apparatus adapted to be used with an electrophotographic apparatus in which an electrostatic latent image is formed on a charged electrostatic photosensitive drum and is developed by a toner, said developing apparatus comprising a developer case in which a developer having a mixture of a toner and a carrier is stored, a toner hopper to contain a toner, said hopper connected to the developer case, said toner hopper having a feeding opening which can be selectively connected to the interior of the developer case, a rotatable dosing shaft in the feeding opening, said dosing shaft being adapted to normally close the feeding opening and having an outer periphery with a dosing recess which normally opens into the toner hopper, guiding means for defining said feeding opening, said guiding means comprising elastically deformable guide plates, said guide plates tangentially contacting the outer periphery of said dosing shaft, wherein when the dosing shaft rotates, the dosing recess is adapted to be selectively connected to the developer case to feed a predetermined amount of toner received in the dosing recess into the developer case.

22. A developing apparatus adapted to be used with an electrophotographic apparatus in which an electrostatic latent image is formed on a charged electrostatic photosensitive drum and is developed by a toner, said developing apparatus comprising a developer case in which a developer having a mixture of a toner and a carrier is stored, a toner hopper to contain a toner, said hopper connected to the developer case, said toner hopper having a feeding opening which can be selectively connected to the interior of the developer case, and a rotatable dosing shaft in the feeding opening, said dosing shaft being adapted to normally close the feeding opening and having an outer periphery with a dosing recess which normally opens into the toner hopper, wherein when the dosing shaft rotates, the dosing recess is adapted to be selectively connected to the developer case to feed a predetermined amount of toner received in the dosing recess into the developer case, guiding means defining said feeding opening, said dosing shaft being provided with an elastic film along the dosing recess, said elastic film including a projecting tongue projecting outwardly from the dosing recess, wherein when the dosing shaft rotates, the projecting tongue is adapted to engage and disengage the guiding means of the feeding opening.

* * * * *

UNITED STATES PATENT AND TRADEMARK OFFICE

CERTIFICATE OF CORRECTION

PATENT NO. : 4,967,691

DATED : November 6, 1990

INVENTOR(S) : A. CHIKAMA et al.

It is certified that error appears in the above-indentified patent and that said Letters Patent is hereby corrected as shown below:

At column 9, line 47 (claim 5, line 3), delete "to" (first occurrence).

Signed and Sealed this

Nineteenth Day of April, 1994

*Attest:*

*Attesting Officer*

BRUCE LEHMAN

*Commissioner of Patents and Trademarks*